US005185064A

United States Patent [19]

Nyman

[11] Patent Number: 5,185,064

[45] Date of Patent: Feb. 9, 1993

[54] MEANS FOR CONTROLLING WIRES IN A PAPER MACHINE OR CARDBOARD MACHINE

[75] Inventor: Tapani Nyman, Karhula, Finland

[73] Assignee: Valmet-Ahlstrom Inc., Karhula, Finland

[21] Appl. No.: 758,264

[22] Filed: Aug. 26, 1991

Related U.S. Application Data

[63] Continuation of Ser. No. 241,938, Sep. 6, 1988, abandoned.

[30] Foreign Application Priority Data

Sep. 7, 1987 [SE] Sweden ..... 8703468

[51] Int. Cl.[5] ..... D21F 1/36

[52] U.S. Cl. ..... 162/301; 162/303; 162/352; 162/354; 162/364

[58] Field of Search ..... 162/203, 205, 207, 224, 162/301, 303, 352, 354, 364; 92/37-39

[56] References Cited

U.S. PATENT DOCUMENTS

| | | | |
|---|---|---|---|
| 3,027,940 | 4/1962 | Dunlap | 162/352 |
| 4,559,105 | 12/1985 | Sennett et al. | 162/352 |
| 4,769,111 | 9/1988 | Nevalainen et al. | 162/301 X |

*Primary Examiner*—Thi Dang
*Attorney, Agent, or Firm*—Dellett, Smith-Hill and Bedell

[57] ABSTRACT

A means for controlling wires in a twin-wire section in a paper or cardboard machine where the wires run over the other for dewatering stock that is present between the wires, where a dewatering box is provided on one side of the wires and where a number of strips disposed side by side are provided on the other side of the wires, said strips running across the transport direction of the wires and over the total width of the wires, and where the strips have been arranged to be pressed against the wire lying closest to the strips, with the aid of pressure elements, where said pressure elements are disposed to act between the strips and a supporting table or equivalent, said supporting table being fixedly mounting relative to said dewatering box. The invention is characterized in that for each strip (16) has been provided a separate pressure element (15), where every one of the pressure elements (15) comprises at least two force-supplying members (19,20) provided between the respective strip and the supporting table (13), said members (19,20) being disposed to displace the strip (16) in the direction toward and away from said dewatering box (10), that a first one (19) of the members has been disposed to act against the forward end (25) of the strip in the transport direction of the wires and that a second one (20) of the members has been disposed to act against the rear end (28) of the strip in said transport direction, and that the force-supplying members (19,20) are individually controllable so that on one hand the pressure of the strip (16) against the wire and on the other hand the angle of the top surface of the strip against the wire can be adjusted.

19 Claims, 3 Drawing Sheets

FIG. 2
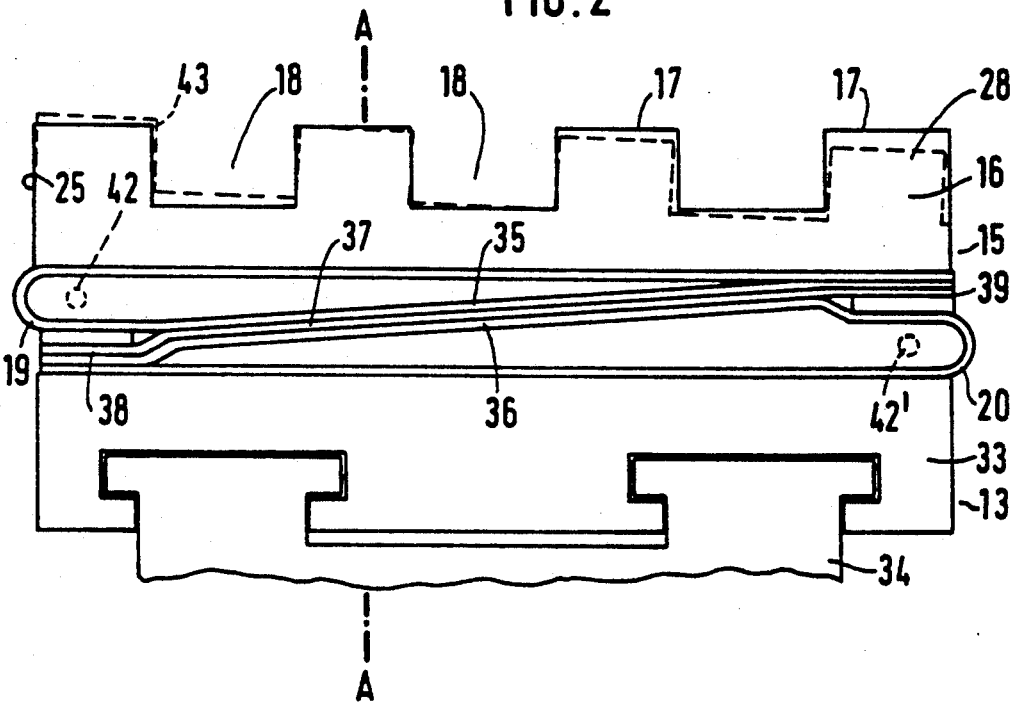
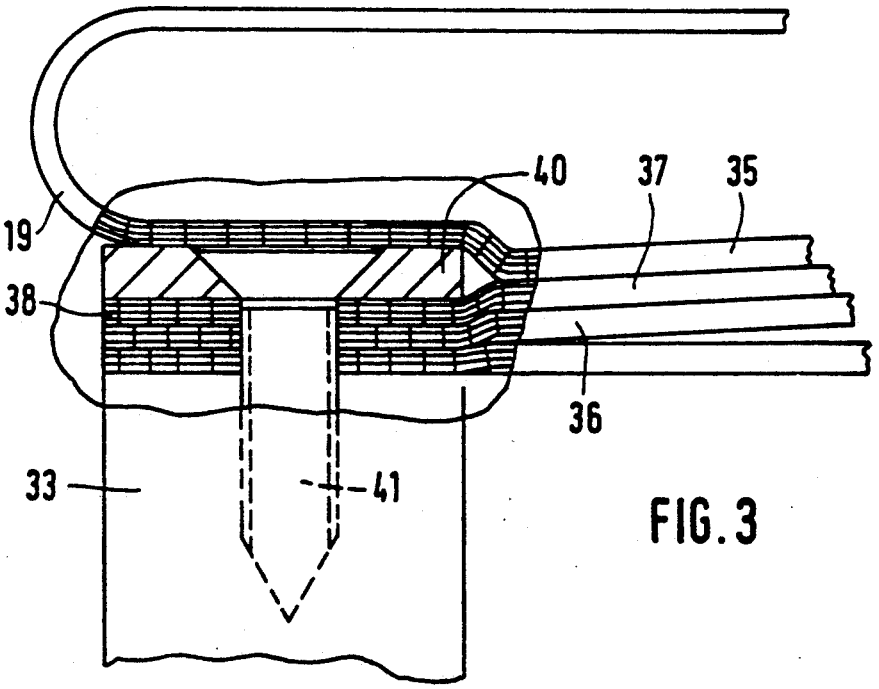
FIG. 3

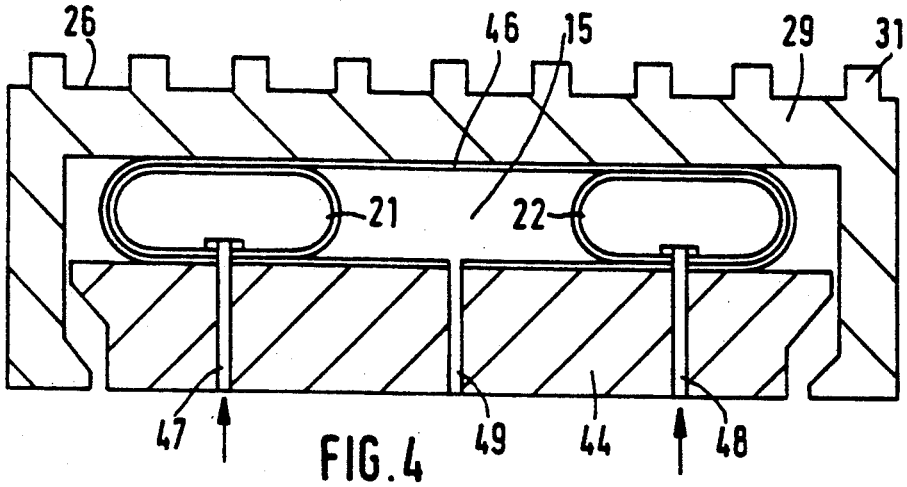
FIG. 4
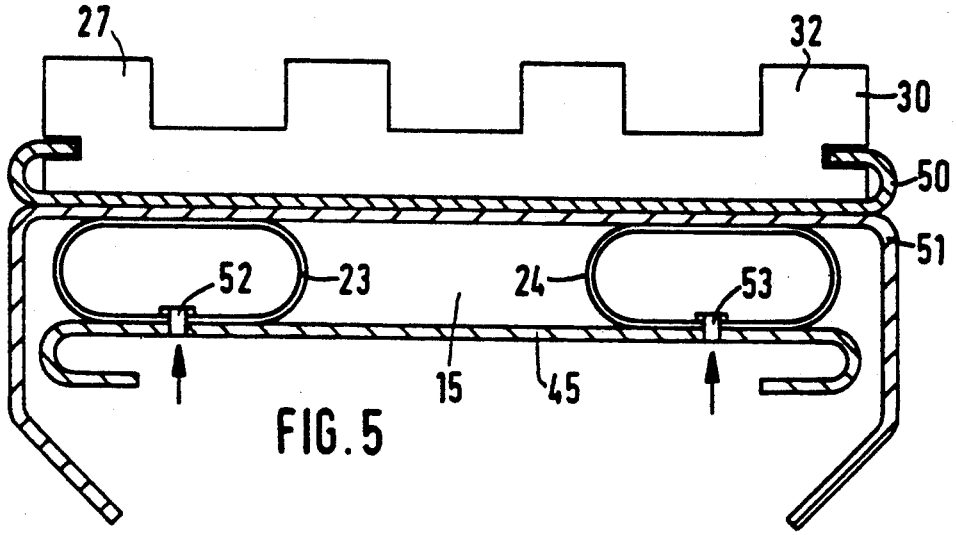
FIG. 5
FIG. 6
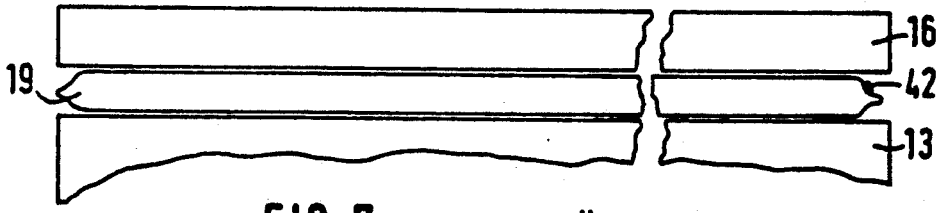
FIG. 7
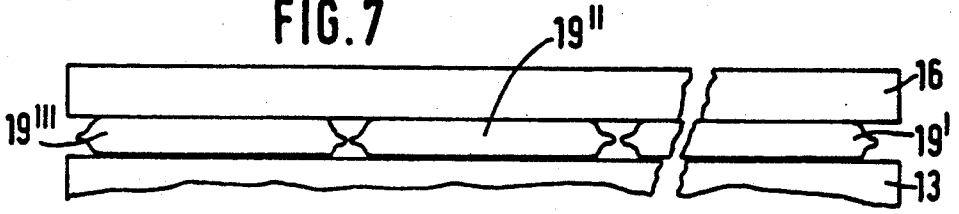

MEANS FOR CONTROLLING WIRES IN A PAPER MACHINE OR CARDBOARD MACHINE

This is a continuation of application Ser. No. 07/241,938 filed Sep. 6, 1988 and now abandoned.

The present invention concerns a means for controlling wires in a paper machine or in a cardboard machine.

More specifically, the means relates to the controlling of wires in a twin-wire section where the wires run parallel, one above the other, and where stock is introduced between said wires to be dewatered. There is usually a dewatering box above the upper wire, partial vacuum prevailing in said dewatering box in order to suck up water that has been expressed from the stock. Under the lower wire is provided a supporting table or equivalent, which is fixed relative to the dewatering box.

It is desirable, and necessary, in machines of this kind to be able to change, on one hand, the thickness of the gap defined between the wires and, on the other hand, the configuration of said gap in the transport direction of the wires.

To this purpose there are controlling members to urge the lower wire upwards in a direction against the upper wire, which in its turn lies against the dewatering box.

It is thus understood that said controlling members act between the supporting table and the lower wire.

In the Swedish Patent No. 8501985-9 a wire controlling track is disclosed wherein is provided a number of strips positioned closely side by side and extending over the wire width, said strips lying against the lower wire and the pressure of said strips against the lower wire being adjustable. The strips are displaceable towards the lower wire and away therefrom, but the angle of the top surfaces of said strips against the wire transport plane is not adjustable.

The problem solution described in the Swedish Patent No. 8501985-9 is furthermore encumbered by the drawback that the strips lie close together. This has the effect that the strips act on each other through friction, and proper control is therefore impeded. This is emphasized through the fact that the strips tend to assume oblique position so that their top surfaces are not fully parallel to the transport plane of the wires, owing to friction against the lower wire. Moreover, liquid cannot escape downward in said means unless the strips are designed to have suction slits or equivalent.

In the German Patent No. 3,153,305 another wire controlling track is disclosed wherein a number of mutually spaced strips are present, lying against the lower wire. These strips are individually regulated as regards their pressure against the lower wire, with the aid of a spring member. However, each strip is pivotally connected with the spring member coordinated with the particular strip, and therefore the position of the top surface of the strips relative to the horizontal plane cannot be adjusted. Thus, according to this patent, compensation of inclined position of the strips' top surfaces relative to the surface of the lower wire, owing to friction between the lower wire and the strips, is not feasible.

Various problem solutions serving to adjust the pressure against the wire, and thereby against the stock, are thus known in the art.

It has turned out that, in order to attain optimum functioning regarding dewatering of stock in a twin-wire section, it is essential that the pressure against the forward end of the strips, in the transport direction, and that against the rear end is separately adjustable.

This enables any desired pressure profile to be set up over each strip. Furthermore, the inclined positioning mentioned above can be eliminated.

The present invention teaches a means by the aid of which it becomes possible to achieve what has just been said.

Furthermore, the construction of the means is simple and sturdy.

It is thus understood that the present invention relates to a means for controlling wires in a twin-wire section in a paper or cardboard machine where the wires run one over the other, for dewatering stock that is present between the wires, where a dewatering box is provided on one side of the wires and where a number of strips disposed side by side are provided on the other side of the wires, said strips running across the transport direction of the wires and over the entire width of the wires and where the strips have been arranged to be pressed against the wire located nearest to the strips, with the aid of pressure elements, where the pressure elements are arranged to act between the strips and a supporting table or equivalent, said supporting table being fixedly mounted relative to said dewatering box and being characterized in that for each strip a separate pressure element is provided, where each one of the pressure elements comprises at least two force-supplying members provided between the respective strip and the supporting table, said members being arranged to displace the strip in the direction towards and away from said dewatering box, that a first one of the members has been arranged to act against the forward end of the strip in the transport direction of the wires and that a second one of the members has been arranged to act against the rear end of the strip in said transport direction, and in that the force-supplying members are individually controllable so that on one hand the pressure of the strip against the wire and on the other hand the angle against the wire of the top surface of the strip can be adjusted.

The invention is more closely described in the following in connection with the attached drawings showing embodiment examples of the invention, wherein:

FIG. 2 shows, on larger scale, one strip and ancillary control members according to the invention, in section conforming to the section in FIG. 1.

FIG. 3 shows on an even larger scale the portion of said control member which is on the left in FIG. 2.

FIG. 4 shows a first alternative embodiment of the control member, in section conforming to the section in FIG. 1.

FIG. 5 shows a second alternative embodiment of the control member, in section conforming to the section in FIG. 1.

FIGS. 6 and 7 show various embodiments of force-supplying members, the figures being schematic sections taken in a vertical plane corresponding to the section A—A in FIG. 2.

Figure 1:
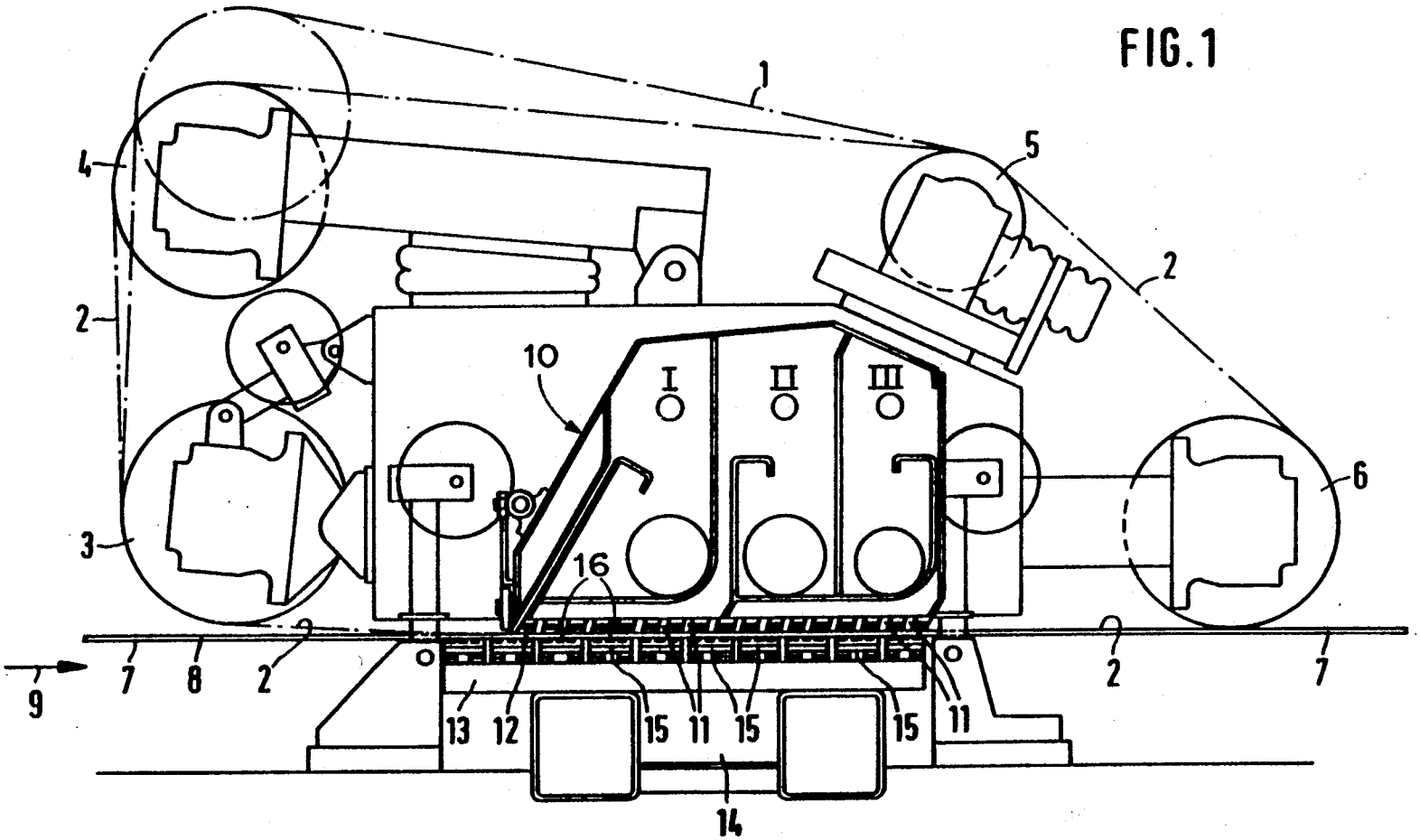
FIG. 1 shows a sectional view of a twin-wire section for a paper machine where the present invention is applied.

In FIG. 1, an elevational view is shown of a twin-wire section 1 of a paper machine, where the upper wire 2 runs over deflection rolls 3, 4, 5 and 6 and where the lower wire 7 runs substantially parallel to the upper wire and under the upper wire 2. The wires 2, 7 define a wedge-shaped entrance portion 8, where the stock is progressively compressed. In FIG. 1 are also shown a multitude of set-up members, which are of a kind known in the art and which therefore are not more closely described.

In the transport direction 9, and after said wedge-shaped entrance portion 8, a dewatering run is provided, comprising a dewatering box 10 containing three chambers I, II and III, which carry different degrees of vacuum. Water from the stock is drawn up by ducts 11 into the chambers. The ducts 11 are included in the bottom 12 of the dewatering box 10. The upper wire 2 runs against this bottom.

Under the lower wire is provided a supporting table 13, mounted fixedly relative to the dewatering box 10, this table being carried on a stand which has been generally denoted with reference numeral 14.

Upon the supporting table 13 is provided a control member in the shape of a number of pressure elements 15 arranged to press respective pressing the strips 16 upward in FIG. 1 and thereby to apply pressure against the lower wire 7, and thereby against the stock.

These pressure elements 15, one of which is shown on a larger scale in FIG. 2, are thus placed between the underside of the strips 16 and the supporting table 13. As has been mentioned, the top surfaces of the strips have been disposed to lie against the lower wire 7.

The strips 16 are provided with grooves 18 for carrying off water from the stock.

According to the present invention, a separate pressure element 15 has been provided for each strip 16, each one of the pressure elements comprising at least two force-supplying members 19,20;21,22;23,24, between the respective strip 16,31,32 and the supporting table 13. The members 19-24 are disposed to displace the strips in the direction toward and away from the dewatering box 10. A first one of the members 19;21;23 is disposed to act against the forward end 25;26;27 of the respective strip 16,31,32 in the transport direction of the wires, and a second one of the members 20;22;24, to act against the rear end 28;29;30 of the strip in the transport direction of the wires.

Furthermore, the force-supplying members 19-24 are individually controllable so that on one hand the pressure of the strip against the lower wire, and on the other hand the angle of the top surface of the strip with reference to the lower wire, can be adjusted.

According to a preferred embodiment, the strips 16,31,32 are placed paralleling each other, and spaced from each other. The distance between strips amounts only to a fraction of the width of one strip in the transport direction of the wires.

This entails that the strips cannot affect each other by hooking onto each other or by lying tight together, which would be the case if the strips were placed very close to each other. If such interference were to occur, the individual adjustment of the strips would be impeded.

It is thus obvious that the present invention completely solves the initially stated drawbacks of the means of prior art.

The present invention therefore results in every strip being individually adjustable so that optimum control of the controlling track in the twin-wire section can be obtained.

According to a specially preferred embodiment of the invention, the force-supplying members comprise rubber bellows or equivalent, arranged to be controlled with the aid of compressed air.

In FIG. 2 is shown a first embodiment of the invention, corresponding to the embodiment depicted in FIG. 1.

According to this embodiment, the supporting table comprises a supporting heel 33, mounted on the carrying frame 34 of the supporting table 13.

According to the embodiment depicted in FIG. 2, each one of the force-supplying members consists of a rubber bellows 19,20, where the two bellows 19,20, seen in section transversal to the longitudinal direction of the pressure element, are wedge-shaped and are placed against and upon each other so that together they constitute a substantially rectangular pillow between the strip 16 and the supporting table 13.

The rubber bellows are preferably made of fabric-reinforced rubber, or of material having equivalent properties.

Between the sides 35,36 of the bellows 19,20 which face each other is provided a fixing element 37 in the shape of a plate. One marginal part 38 of the fixing element is integrally connected with the supporting table 13(33), and the other marginal part 39 of the fixing element is integrally connected with the strip 16.

In FIG. 3, the fixing which is on the left in FIG. 2 is shown on a larger scale. In FIG. 3 is also shown the left margin of the lower bellows 20, fixed in place with a screwed joint to the supporting table. The reference numeral 40 indicates a clamp of plastic or metal and numeral 41, a screw.

The fixing element may likewise be made of fabric-reinforced rubber, but it may also be made of sheet metal.

In FIG. 2, interrupted lines schematically indicate nipples 42,42' for introducing and carrying off compressed air to the bellows 19,20. The nipples are preferably placed on the respective end of the bellows.

It is obvious that if compressed air is introduced in the bellows 19 up to pressure higher in bellows 19 than in bellows 20, the left end of the strip 19, its forward end, will be raised more than its right-hand end, the rear end. This is illustrated by the interrupted line 43 in FIG. 2.

Suitably, the surfaces of the bellows adjoining the underside surface of the strip 16 and the top surface of the supporting heel 33 have been affixed to the respective surface. This may be done with mechanical junctures or by cementing the bellows to the respective surface.

In FIGS. 4 and 5, other alternative preferred embodiments are shown.

According to these embodiments, the strip 31;32, respectively the supporting table 44;45, partly embrace each other so that the strip 31;32 has only limited mobility relative to the supporting table 44;45. Due to this embodiment there is no need for any fixing element of the type just described in connection with FIG. 2.

According to the embodiment depicted in FIG. 4, a further bellows 46 has been provided which holds within itself the two bellows 21 and 22 already mentioned. These inner bellows 21,22 are fixed to the outer bellows 46, which in turn is preferably affixed to the strip 31, and the supporting table 44, by means of mechanical junctures or by cementing.

A duct serving introduction and evacuation of compressed air is provided to each inner bellows 21,22.

As can be seen in FIG. 4, the strip is restrictedly displaceable through a very short distance in the left/-right direction in FIG. 4. The strip is further restrictedly displaceable upward/downward in FIG. 4, though through a longer distance than in the left/right direction. Actually, there is no desire to make the strip displaceable in the left/right direction: the free play which is present between the strip and the supporting table is merely conducive to easier upward/downward displacement and inclined positioning of the top surface of the strip.

A duct 49 between the outer bellows and free atmosphere must be provided. As an alternative, the ends of the outer bellows may be open.

In FIG. 5 is shown an embodiment equivalent to that of FIG. 4, featuring two bellows 23,24 fixed in a carrying member 50,51, for the strip 32, and a portion 45 belonging to the supporting table.

According to this embodiment, too, the strip is restrictedly displaceable relative to the supporting table. Ducts 52,53 have been provided for supplying and carrying off compressed air.

According to the embodiments described in connection with FIGS. 4 and 5 as well, the bellows 21,22,46,23,24 are preferably made of fabric-reinforced rubber material.

The strips are made of some suitable, wear-resistant material.

According to an embodiment, shown in FIG. 6, every rubber bellows 19 has a length consistent with the total length of the strips 16. However, according to another embodiment one bellows or both bellows carrying a strip 16 may consist of two or more bellows 19',19'',19''' located after each other in their longitudinal direction, so that the bellows 19',19'', 19''' in combination constitute a force-supplying member having a length consistent with the total length of the strips 16, see FIG. 7. In that case, every bellows 19',19'',19''' is provided with a nipple for supplying and letting off compressed air. Each bellows 19',19'',19''' is individually adjustable.

This embodiment implies that it is even possible to control the pressure profile across the width of the wire 7.

According to a further alternative embodiment, a long bellows extending over the entire width of the wire may be subdivided into different sections.

In the foregoing various exemplifying embodiments have been described.

It is obvious that the bellows may have other shapes and cover a greater or smaller part of the underside of the strips and of the top surface of the supporting table as seen in section according to FIGS. 2, 3 and 4. Furthermore, the bellows may be made of materials other than have been mentioned in the foregoing and which are suitable in the application in hand.

It goes without saying that the strips may be given other embodiments, as may also the supporting table.

Furthermore, the fixing element 37 may constitute a spring element in case it is made of metal.

Thus and therefore it is obvious that the present invention shall not be considered confined to the embodiments presented in the foregoing, and that it may rather be varied within its frame as stated by the claims following below.

I claim:

1. A twin-wire section for a paper or cardboard machine, comprising:

a dewatering box, a back-up member fixedly mounted relative to the dewatering box, first and second wires running between the dewatering box and the back-up member for dewatering stock that is present between the wires, the first wire being positioned between the second wire and the back-up member, and a plurality of pressing devices disposed between the back-up member and the wires, the pressing devices being disposed side-by-side and each comprising an elongate pressing strip extending substantially in the cross machine direction and having a forward edge and a rear edge, the pressing strips of the respective pressing devices being spaced from each other in the longitudinal direction of the twin-wire section, and each pressing device further comprising a first pressure member effective between the back-up member and the forward edge of the pressing strip and a second pressure member effective between the back-up member and the rear edge of the pressing strip, the pressure members being individually controllable so that both the pressure of each strip against the first wire and the orientation of each strip relative to the first wire can be adjusted, and the pressing strip of each pressing device being movable by the pressure members of that pressing device independently of the pressing strips of the other pressing devices.

2. A twin-wire section according to claim 1, wherein each pressure member comprises a bellows and means for supplying compressed air to the bellows.

3. A twin-wire section according to claim 2, wherein the first and second pressure members of each pressing device comprise respective bellows that are wedge-shaped in section perpendicular to the longitudinal direction of the pressing strip, the bellows being placed against each other so that together they constitute a substantially rectangular pillow between the pressing strip and the back-up member.

4. A twin-wire section according to claim 3, wherein each pressing device comprises a fixing plate between the two bellows, the fixing plate having one edge secured to the back-up member and an opposite edge secured to the pressing strip.

5. A twin-wire section according to claim 2, wherein the first and second pressure members of each pressing device comprise respective bellows that are substantially oval in section perpendicular to the longitudinal direction of the pressing strip and each bellows is secured to both the pressing strip and the back-up member.

6. A twin-wire section according to claim 2, wherein the length of each bellows is substantially equal to the length of the pressing strip.

7. A twin-wire section according to claim 1, wherein each pressure member of each pressing device comprises at least two elongate bellows placed end-to-end substantially in the cross machine direction, and wherein the aggregate length of the bellows of each pressure member is substantially equal to the total length of the pressing strip.

8. A twin-wire section according to claim 1, wherein in each pressing device the pressing strip partly embraces the back-up member so that the pressing strip is movable relative to the back-up member to only a limited extent.

9. A twin-wire section according to claim 1, wherein each pressing strip is movable relative to the back-up member but is captive relative thereto.

10. A twin-wire section according to claim 1, wherein the dewatering box has at least two dewatering chambers open toward the wires, and each of said two dewatering chambers is confronted across the wires by at least two pressing strips.

11. A twin-wire section according to claim 1, wherein each pressing strip is formed with channels in its surface that confronts the wires.

12. A twin-wire section of a paper or cardboard machine, comprising:

a dewatering box, a back-up member fixedly mounted relative to the dewatering box, first and second wires running between the dewatering box and the back-up member for dewatering stock that is present between the wires, the first wire being positioned between the second wire and the back-up member and a plurality of pressing devices disposed between the back-up member and the wires, the pressing devices being disposed side-by-side and each comprising an elongate pressing strip that extends substantially in the cross machine direction and has a forward edge and a rear edge and is formed with channels in its surface that confronts the wires, a first pressure member effective between the back-up member and the forward edge of the pressing strip, and a second pressure member effective between the back-up member and the rear edge of the pressing strip, and wherein the first and second pressure members of each pressing device comprise respective bellows that are wedge-shaped in section perpendicular to the longitudinal direction of the pressing strip, the bellows being placed against each other so that they constitute a substantially rectangular pillow between the pressing strip and the back-member, and the pressure members are individually controllable so that both the pressure of each strip against the first wire and the orientation of each strip relative to the first wire can be adjusted.

13. A twin-wire section according to claim 12, wherein each pressing device comprises a fixing plate between the two bellows, the fixing plate having one edge secured to the back-up member and an opposite edge secured to the pressing strip.

14. A twin-wire section according to claim 12, wherein each pressing strip partly embraces the back-up member so that the strip is movable relative to the back-up member to only a limited extent.

15. A twin-wire section according to claim 12, wherein each pressing strip is movable relative to the back-up member but is captive relative thereto.

16. A twin-wire section according to claim 12, wherein the dewatering box has at least two dewatering channels open toward the wires, and each of said two dewatering chambers is confronted across the wires by at least two pressing strips.

17. A twin-wire section according to claim 12, wherein the pressing strips of the respective pressing devices are spaced from each other in the longitudinal direction of the twin-wire section.

18. A twin-wire section for a paper or cardboard machine, comprising:

a dewatering box, a back-up member fixedly mounted relative to the dewatering box, first and second wires running between the dewatering box and the back-up member for dewatering stack that is present between the wires, the first wire being positioned between the second wire and the back-up member, and a plurality of pressing devices disposed between the back-up member and the wires, the pressing devices being disposed side-by-side and each comprising an elongate pressing strip extending substantially in the cross machine direction and having a forward edge and a rear edge, a first pressure member effective between the back-up member and the forward edge of the pressing strip, and a second pressure member effective between the back-up member and the rear edge of the pressing strip, the pressure members being individually controllable so that both the pressure of each strip against the first wire and the orientation of each strip relative to the first wire can be adjusted, and the first and second pressure members of each pressing device comprising respective bellows that are wedge-shaped in section perpendicular to the longitudinal direction of the pressing strip, the bellows being placed against each other so that together they constitute a substantially rectangular pillow between the pressing strip and the back-up member.

19. A twin-wire section according to claim 18, wherein each pressing device comprises a fixing plate between the two bellows, the fixing plate having one edge secured to the back-up member and an opposite edge secured to the pressing strip.

* * * * *